US010570723B2

(12) United States Patent
Burke et al.

(10) Patent No.: US 10,570,723 B2
(45) Date of Patent: Feb. 25, 2020

(54) SYSTEM AND METHODOLOGY FOR COUPLING TUBING

(71) Applicant: SCHLUMBERGER TECHNOLOGY CORPORATION, Sugar Land, TX (US)

(72) Inventors: Travis Raymond Burke, Spring, TX (US); James Hall, Spring, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 171 days.

(21) Appl. No.: 15/602,253

(22) Filed: May 23, 2017

(65) Prior Publication Data

US 2017/0335673 A1 Nov. 23, 2017

Related U.S. Application Data

(60) Provisional application No. 62/340,289, filed on May 23, 2016.

(51) Int. Cl.

| | |
|---|---|
| ***E21B 43/10*** | (2006.01) |
| ***E21B 47/00*** | (2012.01) |
| ***E21B 33/04*** | (2006.01) |
| ***E21B 47/01*** | (2012.01) |
| ***E21B 33/12*** | (2006.01) |
| ***E21B 33/14*** | (2006.01) |
| ***E21B 47/12*** | (2012.01) |

(52) U.S. Cl.

CPC ..... *E21B 47/0006* (2013.01); *E21B 33/04* (2013.01); *E21B 33/12* (2013.01); *E21B 33/14* (2013.01); *E21B 43/103* (2013.01); *E21B 43/105* (2013.01); *E21B 43/108* (2013.01); *E21B 47/01* (2013.01); *E21B 47/12* (2013.01)

(58) Field of Classification Search

CPC ..... E21B 43/10–108

See application file for complete search history.

(56) References Cited

U.S. PATENT DOCUMENTS

| | | | | |
|---|---|---|---|---|
| 6,135,204 | A | 10/2000 | McCabe et al. | |
| 2003/0047320 | A1* | 3/2003 | Badrak | E21B 23/00 166/380 |
| 2004/0065446 | A1 | 4/2004 | Tran et al. | |
| 2005/0039927 | A1* | 2/2005 | Wetzel | A45C 13/02 166/384 |
| 2011/0192598 | A1* | 8/2011 | Roddy | E21B 33/13 166/253.1 |
| 2014/0124199 | A1* | 5/2014 | Gorrara | E21B 23/02 166/268 |

FOREIGN PATENT DOCUMENTS

| | | | |
|---|---|---|---|
| WO | 2015175128 | A1 | 11/2015 |
| WO | 2016/089964 | A1 | 6/2016 |

* cited by examiner

*Primary Examiner* — D. Andrews

(57) ABSTRACT

A technique facilitates joining of sections of tubing and related monitoring. An expandable tubular member may be coupled with an external tubing, e.g. a casing. The expandable tubular member is deployed into the external tubing to a desired position. Then, an expandable portion of the expandable tubular member may be plastically deformed in a radially outward direction and into engagement with the external tubing. A sensor system may be combined with the expandable tubular member to monitor a characteristic of the expandable tubular member.

20 Claims, 6 Drawing Sheets

SYSTEM AND METHODOLOGY FOR COUPLING TUBING

CROSS-REFERENCE TO RELATED APPLICATION

The present document is based on and claims priority to U.S. Provisional Application Ser. No. 62/340,289, filed May 23, 2016, which is incorporated herein by reference in its entirety.

BACKGROUND

Oil and gas wells may be completed by drilling a borehole in the earth and subsequently lining the borehole with a steel casing. In many applications, one or more sections of casing and one or more liners are used to complete the well. After the well has been drilled to a first depth, for example, a first section of casing may be lowered into the wellbore and hung from the surface. Cement is then injected into the annulus between the outer surface of the casing and the borehole. After drilling the well to a second designated depth, a liner is run into the well. The liner may then be fixed to the casing by using a liner hanger.

SUMMARY

In general, the present disclosure provides a system and methodology for joining sections of tubing. For example, an expandable tubular member may be coupled with an external tubing, e.g. casing. The expandable tubular member is deployed into the external tubing to a desired position. An expandable portion of the expandable tubular member may then be plastically deformed in a radially outward direction and into engagement with the external tubing. A sensor system may be combined with the expandable tubular member to, for example, monitor a characteristic of the expandable tubular member.

BRIEF DESCRIPTION OF THE DRAWINGS

Certain embodiments will hereafter be described with reference to the accompanying drawings, wherein like reference numerals denote like elements. It should be understood, however, that the accompanying figures illustrate various implementations described herein and are not meant to limit the scope of various technologies described herein, and.

DETAILED DESCRIPTION

Figure 1:
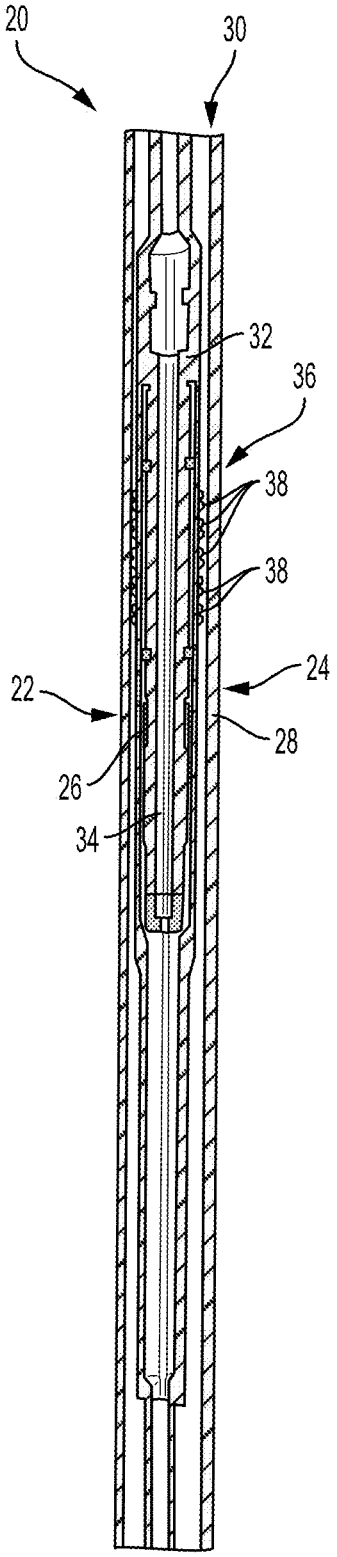
FIG. 1 is a cross-sectional illustration of an example of a tubing coupling system having an expandable tubular member disposed within an external tubing, according to an embodiment of the disclosure.

In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

The disclosure herein generally relates to a system and methodology for a joining sections of tubing. For example, an expandable tubular member, e.g. an expandable tubing hanger, may be coupled with an external tubing, e.g. a casing. The expandable tubular member may be deployed into the external tubing to a desired position. Then, an expandable portion of the expandable tubular member may be plastically deformed in a radially outward direction and into engagement with the external tubing. In some embodiments, the expandable portion is expanded into a metal-to-metal sealing engagement with an inside surface of the surrounding external tubing.

A sensor system may be combined with the expandable tubular member to, for example, monitor a characteristic of the expandable tubular member. For example, the sensor system may be used to provide instrumentation for an expandable liner hanger. In this manner, the installation and lifecycle of the expandable liner hanger may be monitored. In some applications, a characteristic such as strain of the metal-to-metal seal may be monitored by the sensor system to ensure the seal is maintained.

According to an embodiment, the system for joining tubulars enables forming a metal-to-metal seal between an expandable tubular member and a casing in a borehole, e.g. a wellbore. An expansion tool is used in combination with the expandable tubular member to deliver a high-pressure fluid to a sealed region between the expansion tool and the expandable tubular member. The high-pressure fluid causes expansion of at least a portion of the expandable tubular member into engagement with the surrounding tubing, e.g. casing, to thus form a coupling with the surrounding tubing, e.g. a metal-to-metal seal with an interior surface of the surrounding tubing.

With respect to another aspect of this embodiment, a monitoring system may be provided for the expandable tubular member. By way of example, the monitoring system may work in cooperation with the portion of the expandable tubular member which is expanded by high-pressure fluid. The monitoring system may comprise a sensor system, e.g. at least one gauge, disposed proximate the expandable tubular element for assaying a characteristic or characteristics of the expanded tubular element. The sensor system, e.g. gauges, may be used in cooperation with various monitoring system components to obtain data and to provide the data at a surface location. According to a methodology, a monitoring device may be deployed downhole proximate the gauges or other sensor system for collecting data on the characteristic or characteristics of the expanded tubular member. The collected data is then provided to, for example, a processing system to enable analysis of the data for determining health of the expanded tubular, e.g. the integrity of the coupling.

Referring generally to FIG. 1, an embodiment of a system 20 for joining tubular members is illustrated and comprises an expandable tubular member 22 which may be inserted and subsequently expanded into engagement with an external or surrounding tubing 24. By way of example, the expandable tubular member 22 may be in the form of an expandable liner hanger 26 and the surrounding tubing 24 may be in the form of casing 28 disposed in a borehole 30, e.g. a wellbore.

The expandable tubular member 22, e.g. expandable liner hanger 26, may be releasably coupled with an expansion tool 32 via a latch or other releasable coupler. The expansion tool 32 is able to move the expandable tubular member 22 into the surrounding tubing 24. The expansion tool 32 may then be operated to actuate the expandable tubular member 22 into engagement with the surrounding tubing 24. In the example illustrated, the expansion tool 32 has a longitudinal, internal passage or bore 34 which may be used to deliver fluid along an interior of the expansion tool 32.

A sensor system 36 may be positioned along the tubular member 22. By way of example, the sensor system 36 may comprise a sensor or a plurality of sensors 38, e.g. gauges. The sensors 38 may be positioned along the expandable tubular member 22, e.g. along an external surface of the expandable tubular member 22 for engagement with an interior surface of the surrounding tubing 24. However, the sensor system 36 may comprise additional sensors 38 and/or other sensors 38 located on the external surface, internal surface, or at other suitable locations along the expandable tubular member 22 according to the parameters of a given operation. The sensors 38 are positioned to enable monitoring of a desired characteristic or characteristics related to the expandable tubular member 22. For example, at least one of the sensors 38 may be used for monitoring engagement of the expandable liner hanger 26 with the surrounding well casing 28.

Figure 2:
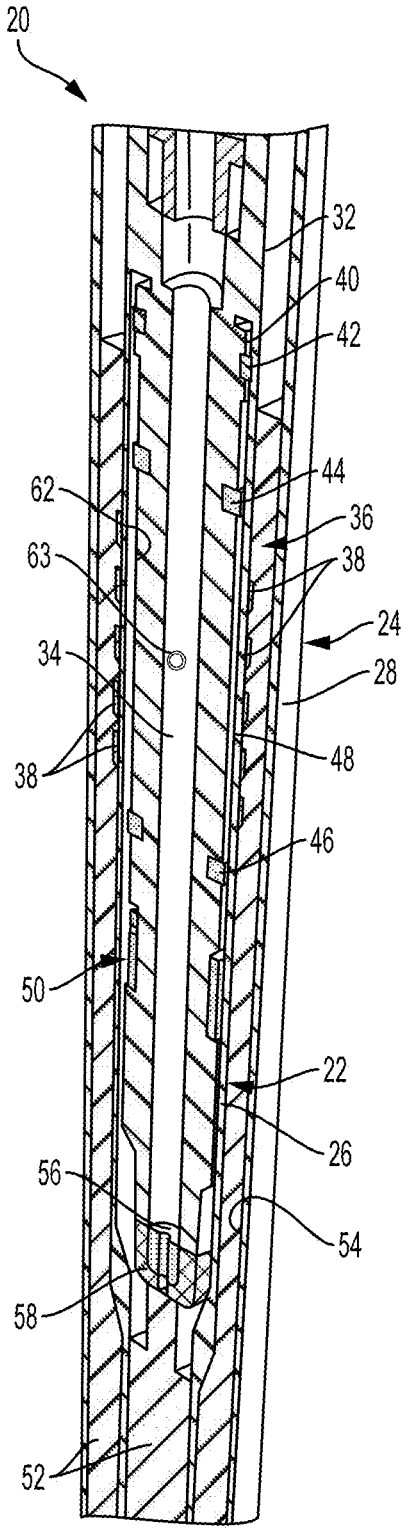
FIG. 2 is a cross-sectional illustration of a portion of the tubing coupling system illustrated in FIG. 1 following a cementing operation, according to an embodiment of the disclosure.

With additional reference to FIG. 2, the expansion tool 32 may comprise a seal system 40 having, for example, a plurality of seals 42, 44, 46. In the illustrated embodiment, the seals 42, 44, 46 are positioned for sealing engagement with an interior surface of tubular member 22 when the expansion tool 32 is inserted into the interior of tubular member 22. The seal system 40 may be constructed such that specific seals, e.g. seals 44, 46, are positioned proximate an expandable portion 48 of expandable tubular member 22 once expansion tool 32 is inserted into engagement with tubular member 22. In some embodiments, the expansion tool 32 also may comprise a locking mechanism 50 positioned to interact with expandable tubular member 22 and to releasably lock the expansion tool 32 to tubular member 22 at a desired engagement position with respect to tubular member 22.

Depending on the type of application in which expandable tubular member 22 is employed, the expansion tool 32 may be used to facilitate various downhole operations. In the embodiment illustrated in FIG. 2, the expandable tubular member 22 is in the form of expandable liner hanger 26 and expansion tool 32 may be used to facilitate a cementing operation. For example, a cement slurry 52 may be pumped down through longitudinal passage 34, along an interior of expandable liner hanger 26, and back up through an annulus 54 between expandable liner hanger 26 and the surrounding casing 28. In this manner, the liner hanger 26 may be cemented into position within casing 28 by forming a cement region therebetween.

Subsequently, a plug 56 may be used to block further flow of fluid through a bottom end 58 of expansion tool 32. By way of example, the plug 56 may be in the form of a pump down plug which is pumped down along internal passage 34 until being sealably captured in bottom end 56. As the plug 56 is pumped down along internal passage 34, the remaining cement slurry 52 is forced out of expansion tool 32.

Figure 3:
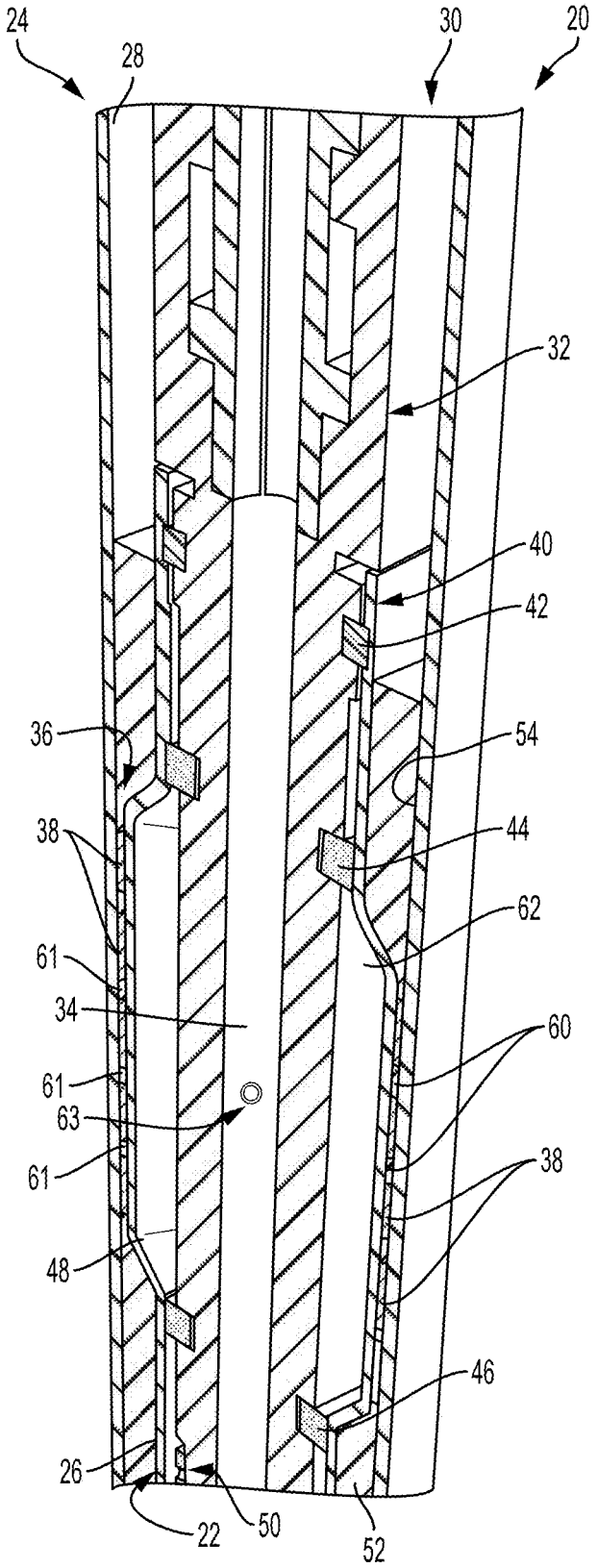
FIG. 3 is a cross-sectional illustration of a portion of the tubing coupling system illustrated in FIG. 1 following plastic deformation of a portion of the expandable tubular member to cause engagement of the expandable tubular member with the external tubing, according to an embodiment of the disclosure.

Once plug 56 blocks further flow of fluid through the bottom of expansion tool 32, a pressurized actuating fluid may be delivered into internal passage 34 and then out to an exterior of expansion tool 32 so as to act against the expandable portion 48 of expandable liner hanger 26. The seals 44, 46 contain the pressurized actuating fluid within the annular region between the seals 44, 46 and between the exterior of expansion tool 32 and the interior of expandable portion 48. When sufficient pressure is applied, the expandable portion 48 is plastically deformed in a radially outward direction, as illustrated in FIG. 3. The expandable portion 48 is expanded outwardly into engagement with the interior surface of the surrounding tubing 24, e.g. casing 28.

In various applications, the expandable portion 48 may be expanded against the interior of tubing 24, e.g. casing 28, to form a metal-to-metal seal 60 between the expandable liner hanger 26 and the surrounding tubing 24/casing 28 as illustrated in FIG. 3. It should be noted the expansion of expandable portion 48 into the metal-to-metal seal 60 with surrounding tubing 24 may be used with a variety of cooperating expandable tubular members 22 and surrounding, external tubings 24. In some embodiments, various types of seal members 61, e.g. seal rings, also may be placed around the expandable tubular member 22. For example, metallic seal rings may be positioned around the expandable portion 48 to facilitate formation of the metal-to-metal seal 60. However, elastomeric rings or other types of seals may be positioned around the expandable portion 48 to ensure formation of the desired seal between tubular member 22 and surrounding tubing 24.

According to an operational example, the radial expansion of expandable portion 48 is facilitated by sealing system 40, e.g. seals 44, 46, which provides a seal between the exterior of the expansion tool 32 and an interior of the expandable liner hanger 26. The actuating fluid may be introduced under high pressure down through internal passage 34 and into an annular volume 62 between expandable liner hanger 26 and expansion tool 32 bounded by seals 44, 46.

By way of example, the high pressure actuating fluid may be delivered from internal passage 34 to annular volume 62 via a suitable pressure crossover mechanism 63, e.g. a radial passage, valve, rupture disc, and/or other suitable mechanism to enable crossover of the pressurized actuating fluid from passage 34 to annular volume 62. The pressure on the actuating fluid is increased until the expandable portion 48 is forced to undergo plastic deformation between seals 44 and 46. As the expanded portion 48 is expanded in the radially outward direction, cement slurry 52 is displaced until the metal-to-metal seal 60 is formed between the exterior surface of expandable tubular member 22, e.g. liner hanger 26, and the interior surface of surrounding tubing 24, e.g. casing 28. In this embodiment, the sensors 38 of sensor system 40 are positioned proximate the metal-to-metal seal 60. It should be noted the sensor system 40 may be used with other types of expansion techniques, e.g. mechanical expansion techniques.

Figure 4:
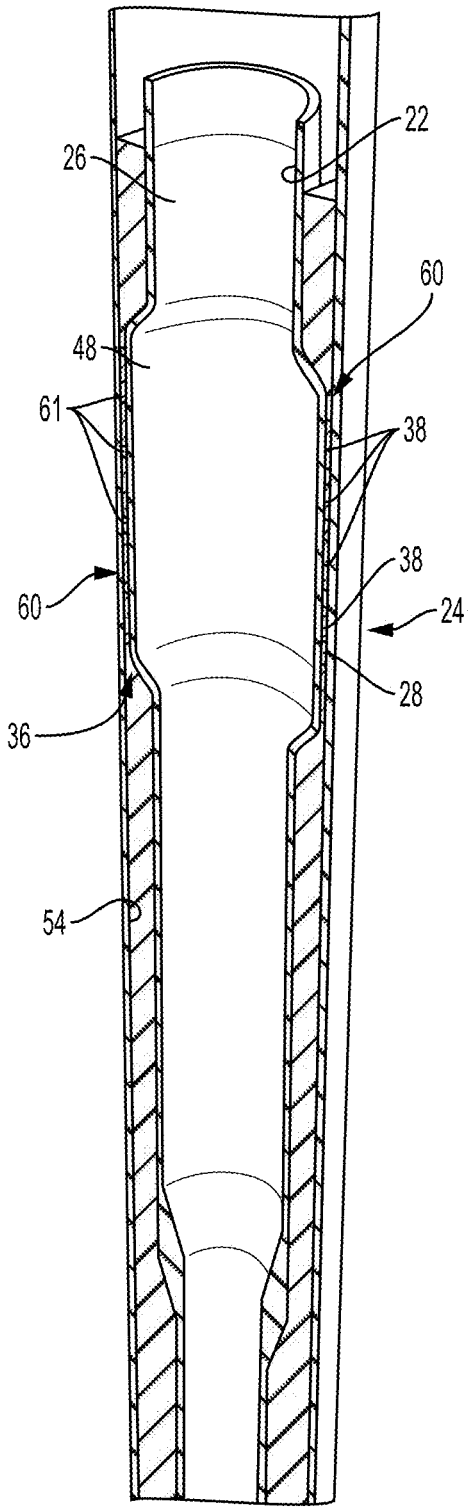
FIG. 4 is an illustration of an example of the expandable tubular member following expansion into engagement with the external tubing, according to an embodiment of the disclosure.

Referring generally to FIG. 4, an illustration is provided showing the exterior of expandable liner hanger 26 following radial expansion of the expandable portion 48. In this illustration, the expandable portion 48 has been sufficiently expanded to form the metal-to-metal seal 60 by displacing the cement slurry 52 and by sufficiently forcing the metal of expandable portion 48 into sealing engagement with the metal of surrounding casing 28. After securing the liner hanger 26 inside the casing 28 through the expansion process, e.g. morphing process, the expansion tool 32 may be decoupled and withdrawn from the expanded liner hanger 26 as illustrated. The expansion tool 32 may be decoupled by releasing a conventional liner hanger latch or other liner hanger coupling mechanism, e.g. locking mechanism 50.

Figure 5:
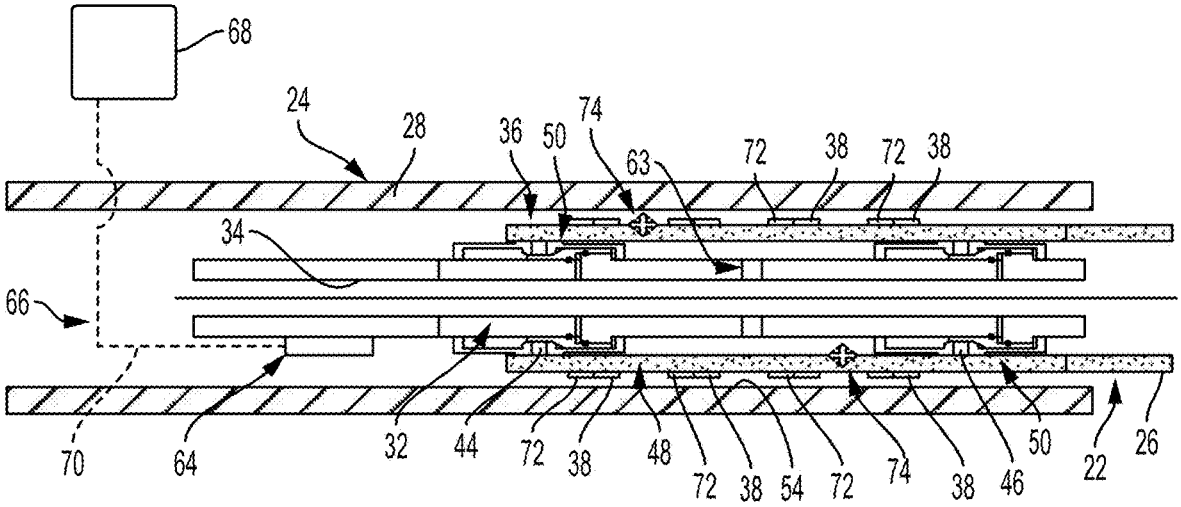
FIG. 5 is a cross-sectional schematic illustration of an example of the expandable tubular member having a sensor system and deployed into the external tubing via an expansion tool, according to an embodiment of the disclosure.
Figure 6:
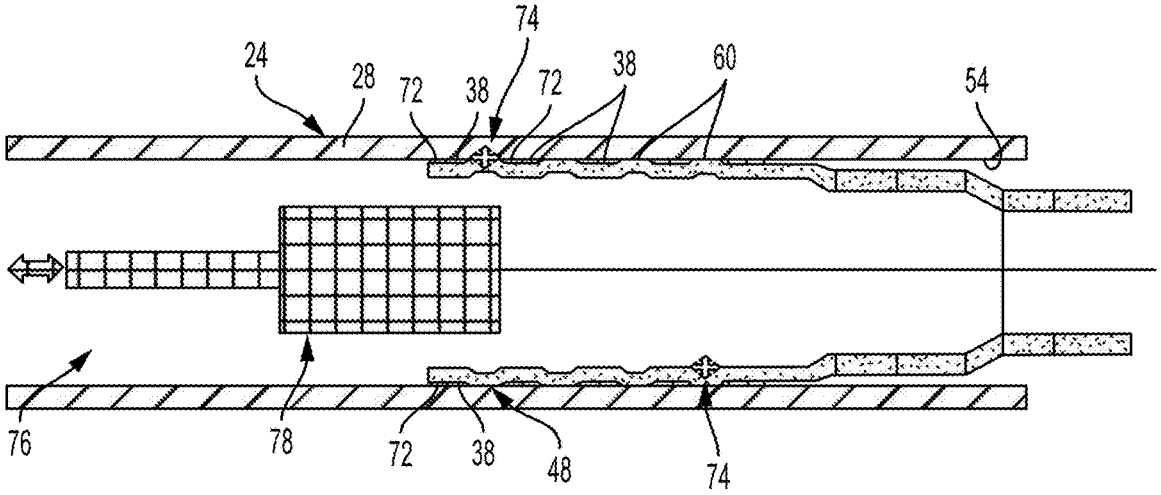
FIG. 6 is a cross-sectional schematic illustration of an example of the expandable tubular member expanded into engagement with the external tubing while a sensor system communicates with a monitoring system, according to an embodiment of the disclosure.

Referring generally to FIGS. 5 and 6, schematic, cross-sectional illustrations are provided to illustrate an example of sensor system 36 utilized with the expandable tubular member 22. The sensor system 36 enables monitoring of the metal-to-metal seal and/or other characteristic or characteristics related to the expandable tubular member 22. In the example illustrated in FIG. 5, the sensor system 36 communicates with a communication system 64 which may be positioned on or combined with expansion tool 32. However, the communication system 64 may be positioned at other locations within casing 28 or at other suitable downhole locations. Additionally, the sensor system 36 may communicate data to communication system 64 wirelessly or via wired couplings which may be engaged upon insertion of the expansion tool 32 into the expandable tubular member 22.

In some embodiments, the communication system 64 is part of an overall telemetry system 66 which enables a communication of data between the downhole communication system 64 and a processing system 68, e.g. a surface processing system. By way of example, the processing system 68 may be in the form of a computer-based system at one or more surface locations.

The overall telemetry system 66 may be a wired system or a wireless system able to communicate data over a suitable communication line 70, e.g. a wired or wireless communication line. In some embodiments, the communication system 64 and the overall telemetry system 66 are in the form of a wireless system which communicates data collected from sensors 38 to an uphole location, e.g. surface based computer processing system 68. An example of a suitable wireless communication system 64 and overall telemetry system 66 is the commercially available MUZIC™ system marketed by Schlumberger Corporation. Another example of a suitable wireless communication system 64 and overall telemetry system 66 is described in published International Application No.: PCT/US2015/063377.

As described above, the sensor system 36 may comprise a variety of types of sensors 38. In some embodiments, the sensors 38 are combined with corresponding electronics 72. The electronics 72 may include or be coupled with a suitable power source, e.g. batteries, for powering the sensors 38 and for communicating with communication system 64. Depending on the parameters of a given application, the electronics 72 may have suitable transmitters or transceivers for communicating wirelessly with communication system 64.

In some embodiments, the sensors 38 are in the form of gauges, e.g. strain gauges, and data 74 obtained by the sensors 38 is communicated to the downhole communication system 64. By way of example, the sensors 38 may be in the form of strain gauges which are pressed between the exterior of expandable portion 48 and the interior of the surrounding casing 28 (or other tubing) when expandable portion 48 is expanded to form the metal-to-metal seal 60. In this application, the sensors/strain gauges 38 are able to provide data 74, e.g. strain data, from proximate the metal-to-metal seal 60. By way of example, the data 74 may comprise strain data indicating the seal 60 has been properly strained and remains healthy or that the seal 60 has been compromised.

According to some embodiments, the communication system 64 is in the form of a wireless communication system used to collect and transmit data 74 related to installation of the expandable tubular member 22. By way of example, the sensors 38 may provide data 74 indicating the expandable tubular member 22 has been satisfactorily expanded and/or that the expansion tool is operating within or outside of operational parameters. For example, after expansion of expandable portion 48 (see FIG. 6) and after plugging of passage 34, strain gauges 38 may be used to capture data 74 which is then transmitted uphole along a well string, e.g. along a drill string, using the wireless telemetry system 66, e.g. the commercially available MUZIC™ system. This wirelessly transmitted data 74 may include indications regarding the status of the expansion of tubular member 22.

In some embodiments, strain gauges 38 may be placed along the outside diameter of the expandable tubular member 22 and at various other positions around the circumference and along the axial length of the expandable tubular member 22. By monitoring the output of these gauges 38, an operator may determine when the desired deformation of expandable portion 48 has occurred to establish the metal-to-metal seal (which may be referred to as an auto-frettaged joint). In a specific example, a material strain target, e.g. 0.2-X percent strain, is established as an indicator that the desired metal-to-metal seal at the joint has been established and that the expansion tool 32 may be released and retrieved.

Subsequently, a monitoring system 76 may be used to continue monitoring a characteristic or characteristics related to the metal-to-metal seal or other downhole components as illustrated in FIG. 6. By way of example, the monitoring system 76 may comprise a receiver 78 deployed downhole through casing 28 and into proximity with sensor (s) 38 so as to obtain the desired sensor data 74. In some embodiments, the receiver 78 may be a wireless receiver, such as an RFID (radiofrequency identification) receiver able to interact wirelessly with the sensor(s) 38.

If the sensor system 36 comprises strain gauges 38, the RFID receiver 78 may be used to query the strain gauges 38 to obtain residual strain data measured by the strain gauges 38. In some embodiments, the receiver 78 may be deployed via wireline to a region proximate sensors/strain gauges 38. Once the receiver 78 has captured the desired sensor data 74, the receiver 78 may be retrieved to the surface where the data may be downloaded and processed via, for example, surface processing system 68. The data 74 may be processed to obtain an indication of the system health, e.g. an indication of the integrity of metal-to-metal seal 60. In some operations, the receiver 78 may be constructed to remain downhole and to transmit data to the surface.

Figure 7:
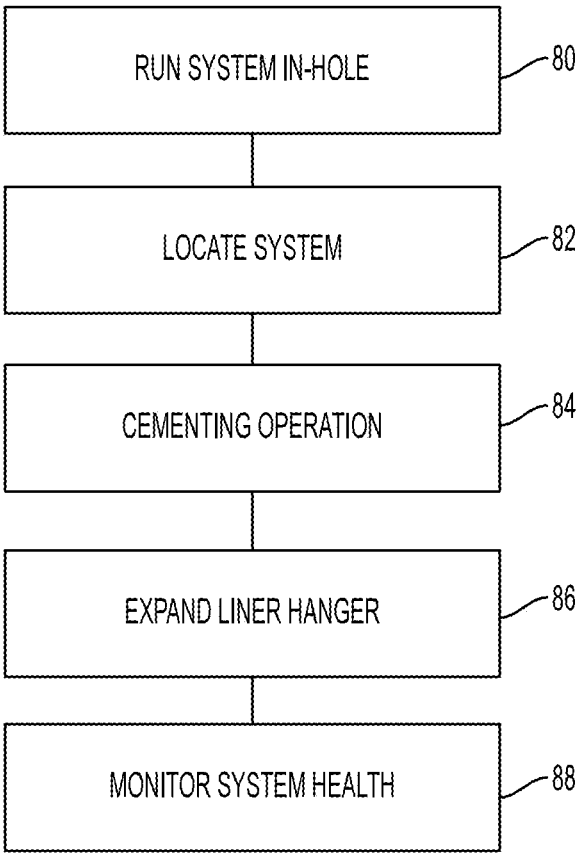
FIG. 7 is a flow chart illustrating an example of a methodology in which an expandable liner hanger is deployed downhole into a surrounding casing and then monitored, according to an embodiment of the disclosure.

Referring generally to FIG. 7, a flowchart illustrates an example of a methodology for installing and monitoring the expandable tubular member 22, e.g. expandable liner hanger 26. In this example, the expandable tubular member 22 and expansion tool 32 are engaged and run downhole as indicated by block 80. The expandable tubular member 22 is then properly located within the surrounding tubing 24, e.g. casing, as indicated by block 82. A cementing operation may then be performed by pumping cement slurry 52 down through longitudinal passage 34 and out into annulus 54, as indicated by block 84. The cement slurry 52 may then be cleared from expansion tool 32 and passage 34 may be plugged at a suitable location. Appropriate actuating fluid may then be delivered downhole under pressure to plastically deform expandable portion 48 of the expandable tubular member 22, e.g. expandable liner hanger 26, as indicated by block 86.

In various applications, the expansion of expandable portion 48 is performed under sufficient force to form the metal-to-metal seal 60 between the tubular member 22 and the surrounding tubing 24. With the aid of sensor system 36, telemetry system 66, and monitoring system 76, the health of the tubular joining system 20, e.g. the health of the metal-to-metal seal 60, may be monitored during installation and/or as a separate operation following installation of the expandable tubular member 22, as indicated by block 88.

Depending on the parameters of a given operation, the components and configurations of the expandable tubular member 22 and the surrounding tubing 24 may vary. If the expandable tubular member 22 comprises expandable liner hanger 26, the size of the liner hanger, the types of liners coupled with the liner hanger, and other parameters of the liner hanger may be selected according to the specifics of a given operation and borehole environment. Similarly, the sensor system 36 may comprise different numbers of sensors and different types of sensors to facilitate monitoring of desired characteristics, e.g. seal integrity and/or other characteristics. Additionally, the expansion tool 32 may comprise various types of fluid passages, locking mechanisms, seals, and/or other features and components. The seals 42, 44, 46 may comprise various types of annular seals, e.g. O-ring seals, disposed about a body of the expansion tool 32.

Although a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for engaging a metallic external tubing in a borehole, comprising:

a metallic tubular member having an expandable portion;

a sensor system disposed along the tubular member at the expandable portion; and an expansion tool inserted into the tubular member and having seals engaging an interior of the tubular member proximate the expandable portion, the expansion tool being constructed to deliver fluid under pressure to a region between the seals to enable plastic deformation by radial expansion of the expandable portion until a metal-to-metal seal is formed between the tubular member and the external tubing wherein the sensor system comprises a plurality of sensors disposed along an exterior surface of the tubular member, and wherein at least one sensor of the plurality of sensors monitors engagement of the expandable portion of the tubular member with the external tubing.

2. The system as recited in claim 1, wherein the expansion tool comprises a longitudinal passage to deliver the fluid.

3. The system as recited in claim 2, wherein the longitudinal passage extends through a bottom of the expansion tool, the system further comprising a plug for selective deployment in the longitudinal passage to block flow through the bottom of the expansion tool.

4. The system as recited in claim 2, wherein the longitudinal passage is configured to deliver cement slurry therethrough during a cementing operation.

5. The system as recited in claim 1, wherein the plurality of sensors comprises a plurality of strain gauges.

6. The system as recited in claim 1, wherein the sensor system is coupled with a communication system mounted on the expansion tool.

7. The system as recited in claim 6, wherein the communication system is part of a wireless telemetry system.

8. The system as recited in claim 1, wherein the sensor system is configured to communicate with a monitoring system deployed downhole after removal of the expansion tool.

9. The system as recited in claim 1, wherein the external tubing comprises well casing.

10. The system as recited in claim 9, wherein the expandable tubular member is an expandable liner hanger.

11. A system, comprising:

a metallic external tubing disposed in a borehole;

a metallic tubular member deployed into the external tubing, the tubular member forming a metal-to-metal seal with the external tubing by expansion and plastic deformation of a portion of the tubular member; and a sensor system positioned along the expanded portion to monitor at least one characteristic of the expanded tubular member, wherein the at least one characteristic of the expanded tubular member comprises engagement of the expanded portion with the external tubing.

12. The system as recited in claim 11, wherein the external tubing comprises well casing.

13. The system as recited in claim 12, wherein the expandable tubular member is an expandable liner hanger.

14. The system as recited in claim 11, wherein the sensor system comprises a plurality of sensors disposed along an exterior surface of the expandable tubular member.

15. The system as recited in claim 11, wherein the sensor system comprises a plurality of strain gauges.

16. A method of engaging an expandable tubular member in a metallic external tubing in a borehole, the expandable tubular member having an expandable portion, the method comprising:

positioning a sensor system on the expandable portion of the tubular member;

inserting an expansion tool into the tubular member;

engaging seals on the expansion tool against an interior of the tubular member proximate to the expandable portion;

deploying the expandable tubular member downhole through the external tubing via the expansion tool;

delivering fluid under pressure through the expansion tool to a region between the seals;

plastically deforming the expandable portion of the expandable tubular member to form a metal-to-metal seal between the expandable tubular member and the external tubing; and using the sensor system to monitor at least one characteristic of the expandable tubular member, wherein the at least one characteristic of the expandable tubular member comprises engagement of the expandable portion and the external tubing.

17. The method as recited in claim 16, wherein deploying the expandable tubular member comprises deploying an expandable liner hanger.

18. The method as recited in claim 16, wherein positioning the sensor system comprises positioning a plurality of sensors along an exterior of the expandable tubular member at the expandable portion.

19. The method as recited in claim 16, wherein the external tubing is a casing.

20. The method as recited in claim 19, further comprising delivering cement slurry through the expansion tool to an annulus between the expandable tubular member and the casing.

* * * * *